United States Patent [19]

Calder

[11] Patent Number: 4,757,947

[45] **Date of Patent: * Jul. 19, 1988**

[54] SPRAY TIP WITH IMPROVED TURRET SEAL

[76] Inventor: Oliver J. Calder, 403 Briardale, No. 5, Orange, Calif. 92665

[ * ] Notice: The portion of the term of this patent subsequent to Nov. 20, 2001 has been disclaimed.

[21] Appl. No.: 77,687

[22] Filed: Jul. 24, 1987

Related U.S. Application Data

[60] Continuation of Ser. No. 894,325, Aug. 7, 1986, abandoned, which is a division of Ser. No. 662,615, Oct. 19, 1984, abandoned, which is a continuation-in-part of Ser. No. 575,153, Jan. 30, 1984, Pat. No. 4,537,355, which is a continuation-in-part of Ser. No. 457,919, Jan. 14, 1983, Pat. No. 4,484,707, which is a continuation-in-part of Ser. No. 442,525, Nov. 18, 1982, Pat. No. 4,483,481, which is a continuation of Ser. No. 165,247, Jul. 2, 1980, abandoned.

[51] Int. Cl.[4] ..... B05B 15/02

[52] U.S. Cl. ..... 239/119; 239/288.3; 239/600

[58] Field of Search ..... 239/119, 288, 288.3, 239/288.5, 600; 251/172, 174; 277/149, 150, 151

[56] References Cited

U.S. PATENT DOCUMENTS

| | | | |
|---|---|---|---|
| 1,954,018 | 4/1934 | Miller | 251/174 |
| 3,118,650 | 1/1964 | Cooper et al. | 251/174 |
| 3,202,360 | 8/1965 | O'Brien | 239/119 |
| 3,228,652 | 1/1966 | Antrim | 251/174 |
| 3,272,473 | 9/1966 | Veit et al. | 251/174 |
| 4,479,513 | 10/1984 | Koch et al. | 251/174 |
| 4,484,707 | 11/1984 | Calder | 239/288.3 |

*Primary Examiner*—Andres Kashnikow
*Assistant Examiner*—Michael J. Forman
*Attorney, Agent, or Firm*—Plante Strauss Vanderburgh

[57] ABSTRACT

There is disclosed a spray tip for airless spraying in which a turret member, which carries the tungsten carbide spray tip, is rotatably mounted in a spray tip housing and is removably and interchangeably received in the housing. The turret member is provided with a dynamic seal which has a seal formed of a very hard plastic, preferably an acetal copolymer that is filled with a reinforcement material, preferably with glass fibers. The hard reinforced plastic resists cold flow and extrusion while, nevertheless, providing a resilient seal that is very effective, even when spraying very low viscosity liquids. Longevity of this seal and ease of rotation of the turret member while maintaining full sealing pressure on the seal is achieved by the cooperative use of a resiliently biased piston support for the seal. The seal is secured to the piston to form a seal subassembly and this subassembly is resiliently biased against the cylindrical face of the turret member by a compression spring captured between the upstream end of the piston and the end face of the spray gun barrel onto which the spray tip is secured.

24 Claims, 2 Drawing Sheets

SPRAY TIP WITH IMPROVED TURRET SEAL

REFERENCE TO RELATED APPLICATIONS

This application is a continuation of application Ser. No. 894,325 filed Aug. 7, 1986 now abandoned, which is a division of application Ser. No. 662,615 filed Oct. 19, 1984 now abandoned, which is a continuation-in-part of Ser. No. 575,153 filed Jan. 30, 1984, now U.S. Pat. No. 4,537,355 issued Aug. 27, 1985 which is a continuation-in-part of Ser. No. 457,919 filed Jan. 14, 1983, now U.S. Pat. No. 4,484,707, issued Nov. 27, 1984, which is a continuation-in-part of Ser. No. 442,525, filed Nov. 18, 1982, now U.S. Pat. No. 4,483,481, issued Nov. 20, 1984, which is a continuation of Ser. No. 165,247, filed July 2, 1980, now abandoned.

BACKGROUND OF THE INVENTION

1. Field Of Invention

This invention relates to a spray tip for airless spraying, and, in particular, to such a spray tip provided with a reversible and interchangeable turret member.

2. Brief Statement Of The Prior Art

In my prior U.S. Pat. No. 3,831,862, I disclosed a spray tip assembly in which the spray tip orifice is mounted in a removable and reversible sleeve which is secured in the housing with a sliding pin interlock that seats against a spring biased seal. This construction requires loosening of the body from its adapter to reverse and/or replace the spray tip orifice.

In my prior U.S. Pat. No. 4,116,386, I disclosed a spray tip assembly in which the spray tip orifice is mounted in a cylindrical turret member which can be rotated in the housing to reverse the orifice member for cleaning. This construction employs a solid, resilient plastic seal which has a concave, cylindrical sealing surface. U.S. Pat. No. 3,202,360 also discloses an airless spray tip having a rotatable turret member, which is sealed with a packing sleeve and nut.

A recently issued U.S. Pat. No. 4,165,836, discloses that plastic seals experience excessive wear and suggests that an entirely metal seal be used to provide metal-to-metal contact with the turret member. My experience with devices of this invention, however, reveals that a metal seal is not efffective with low viscosity liquids, which leak from the assembly under the high pressures used in airless spraying.

In a typical spray application, it is frequently necessary to substitute differently sized orifice members, and this requires interchanging the turret member. Heretofore, the various seals and seal supports dislodged from the spray tips when the turret members were removed, complicating reassembly. It is desirable that the spray tip permit a simple removal and interchanging of the spray orifice without disassembly and without dislodgement of the other parts of the spray tip.

In my parent, copending application, I disclose that difficulties experienced in interchanging turret members can be avoided if the seal is indexed against rotation and retained against dislodgement when the turret member is removed. I also disclosed that the turret member can be sealed effectively against low viscosity liquids without seizure by using a very thin plastic seal on a metal seal support.

While a very thin plastic seal such as disclosed in my parent application provides significant improvement over previous seals in that it permits use of the spray tip with low viscosity liquids without leaking and reduces the tendency of the turret member to seize, further improvement, particularly in longevity of the seal is desirable. In particular, it is desirable to employ a

BRIEF STATEMENT OF THE INVENTION

This invention comprises a spray tip useful for high pressure, airless spraying which utilizes an orifice tip holder which is reversible and which is interchangeable with other holders supporting orifice tips of varied diameters and capacities. In particular, the spray tip member of the invention has a subassembly of a body housing having a longitudinal through passageway with an intersecting, orthogonal bore, and a housing adapter having an inlet port communicating with one end of the longitudinal chamber. A cylindrical turret member is removably and rotatably mounted in the intersecting bore and this turret member has a transverse passageway in which is seated a tungsten carbide, orifice tip member. A seal subassembly is received in the longitudinal through passageway of the housing, and this subassembly includes a seal formed entirely of a reinforced plastic. A very hard plastic such as an acetal copolymer is used and, preferably, this plastic is reinforced with glass fibers. The seal is mounted onto one end of a piston that is slidably received in the through bore of the adapter, and is resiliently biased to compress the seal against the turret member. On its opposite end, the piston is engaged by a compression spring that is captured between the upstream end of the piston and the end face of the barrel of the spray gun on which the spray tip is mounted, to provide the resilient bias for sealing the turret member. The spray tip is secured to the end of a spray gun with a retainer nut that engages a retaining flange carried by the housing adapter.

The spray tip of this invention provides very superior performance over all other spray tips. The seal is indexed and restrained against rotation and dislodgment when the turret member is removed, thereby facilitating replacement of the turret member. The seal is very effective, even with very low viscosity liquids and effectively seals the turret member against all leakage of the spray liquid. The spring biasing the seal subassembly provides a number of advantages. When the tip is placed on a spray gun, the retainer nut can be hand tightened to compress the spring sufficiently to restrain the turret member from falling out of the tip, thus freeing one's hand to apply a wrench for final tightening of the retainer nut and to rotate the tip to the desired alignment on the spray gun. When the retainer nut is tightened sufficiently to prevent leaking under pressure, the spring still provides sufficient resilient bias on the seal to maintain a dynamic seal which freely permits one to rotate the turret member between its cleaning and spraying positions with finger pressure and without releasing the tension on the retainer nut.

BRIEF DESCRIPTION OF THE DRAWINGS

The invention will be described with reference to the FIGURES, of which.

DESCRIPTION OF THE PREFERRED EMBODIMENTS

Figure 1:
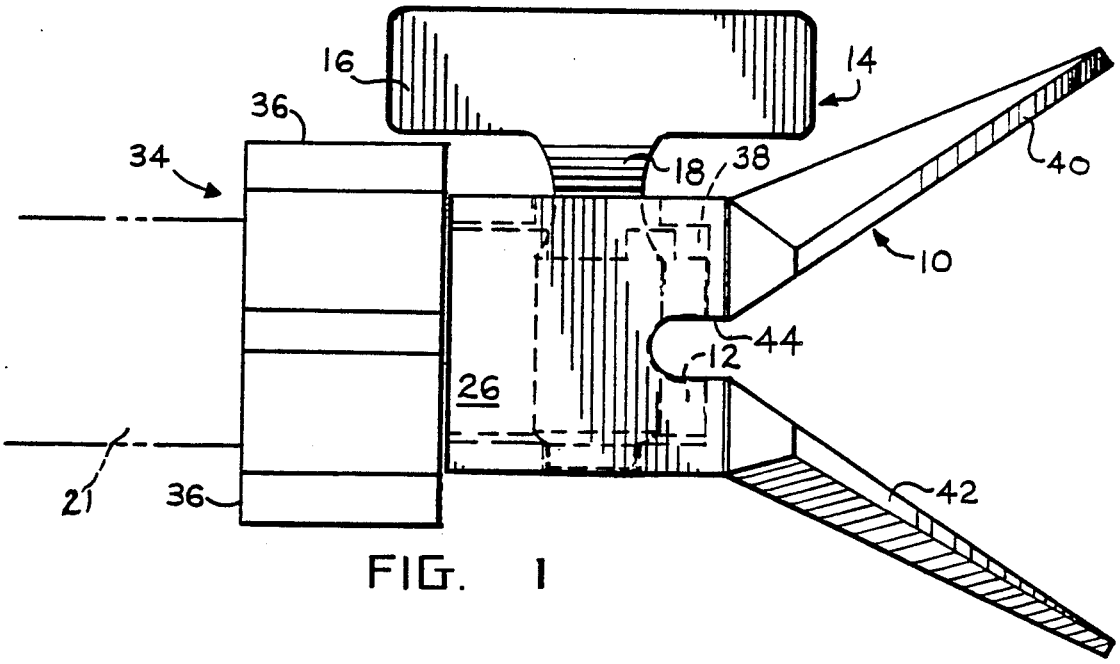
FIG. 1 is a side elevational view of the spray tip.
Figure 2:
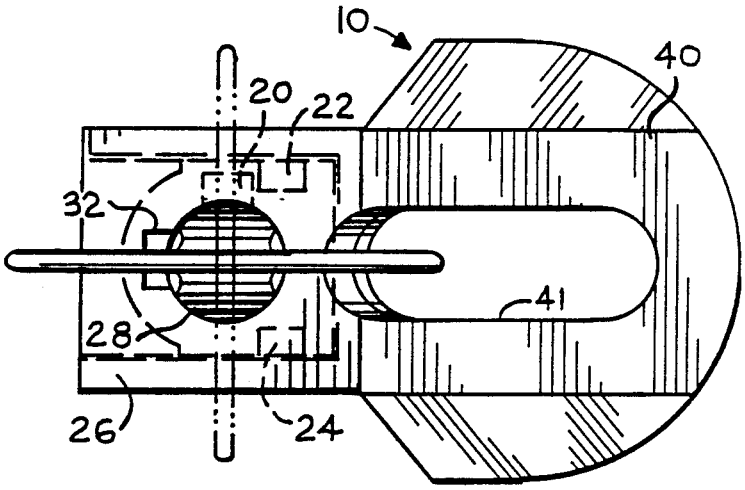
FIG. 2 is a top view of the spray tip.

Referring now to FIGS. 1 and 2, the invention is shown with a spray guard 10 mounted on a housing body 12 which supports a turret member 14. The turret member has a dependent handle 16 on shaft 18 which extends to a cylindrical turret member described in detail hereinafter. The spray guard body 26 has an aperture 28 which receives the turret member 14. The turret member 14 has a radial prong 20 and aperture 28 in spray guard 10 has a notch 32 which permits extraction of the turret member when the latter is rotated to align prong 20 beneath notch 32.

Figure 3:
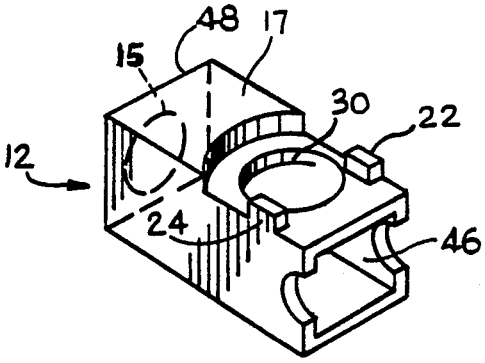
FIG. 3 is a perspective view of the spray tip housing body.

The body 12 is also shown in FIG. 3 with the turret member 14 and spray guard 10 removed. As shown in FIG. 3, body 12 of the spray tip housing has a longitudinal chamber 46 of noncircular, preferably rectangular, cross-section. The end wall 48 is bored to provide the central aperture 15. The housing body 12 also has a cylindrical bore 30 orthogonal to and intersecting the longitudinal chamber 46 and this cylindrical bore 30 receives the cylindrical turret member 14. The top wall 17 of the body 12 has a raised annular shoulder 19 and abutment stops 22 and 24 at its opposite edges. As shown in FIG. 2, these abutment stops serve as limiting stops for the rotation of the turret member, engaging prong 20 and permitting rotation of the turret member through 180 degrees of rotation. These rotation-limiting stops are engaged when the turret member is in either its cleaning or spraying positions.

As shown in FIGS. 1 and 2, the spray guard 10 has a square cross-sectional body 26 with a central cavity 38 that fits over the rectangular body 12 of the spray tip. The spray guard 10 has a pair of outwardly diverging wings 40 and 42 which are generally trapezoidal. At the apex or intersection of wings 40 and 42, the spray guard has a slot 44 to provide clearance for the spray discharged from the spray tip. Each of the outwardly diverging wings 40 and 42 has a longitudinal, central, through slot such as 41. As illustrated for the preferred embodiment, the slots are narrow and extend substantially the entire length of wings 40 and 42.

The spray tip assembly is retained on the externally threaded barrel 21 of a spray gun by the retainer cap nut 34. Tightening of this nut on the threaded barrel of the spray gun axially compresses the internal seals of assembly in a manner described in greater detail hereinafter. For this purpose, lugs 36 can be provided to permit hand tightening of cap nut 34.

Figure 4:
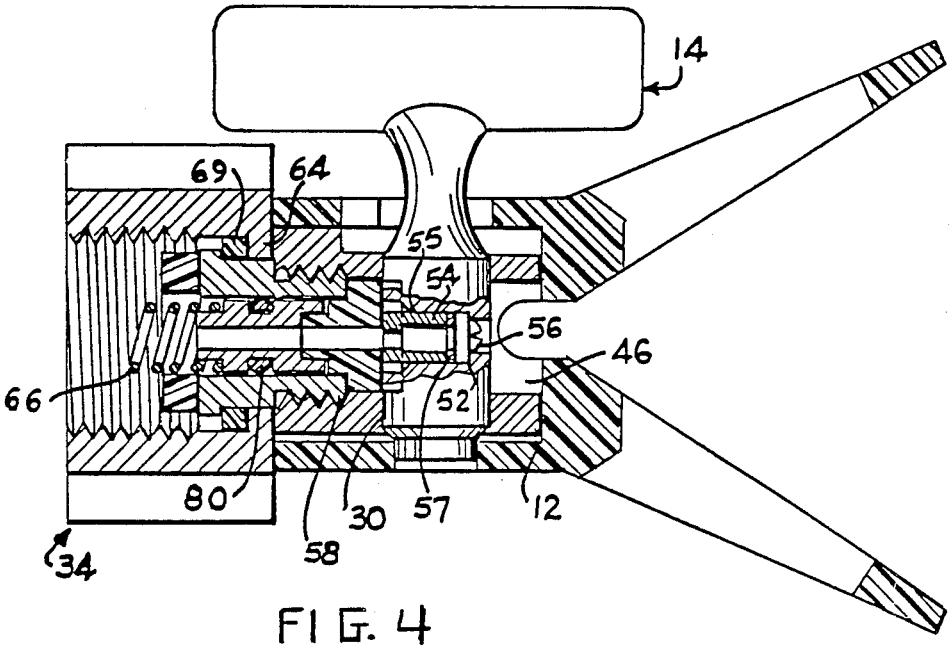
FIG. 4 is a partial sectional elevational view of the spray tip.
Figure 5:
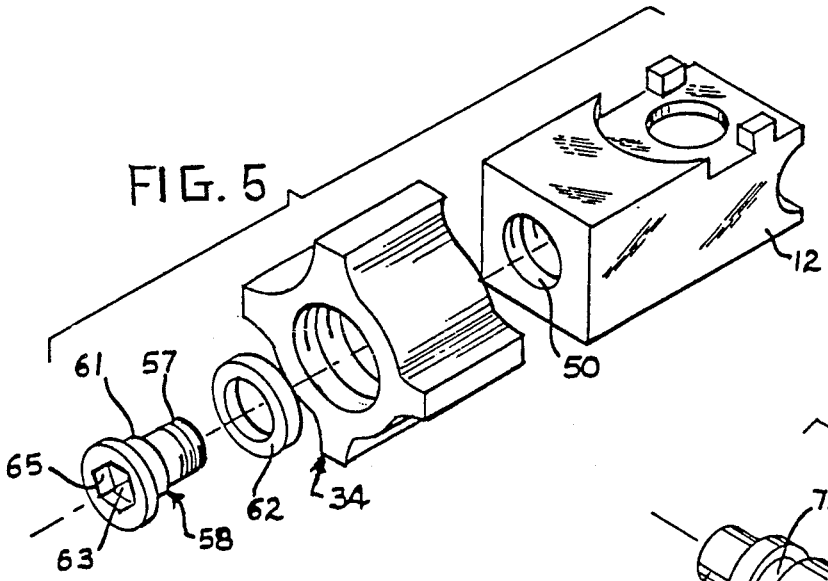
FIG. 5 is an exploded perspective view of the housing body and adapter subassembly.
Figure 6:
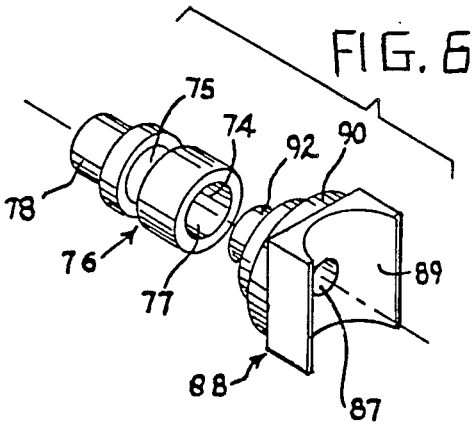
FIG. 6 is an exploded perspective view of the seal subassembly.

Referring now to FIG. 4, the spray tip assembly is shown in greater detail, removed from barrel 21 of the spray gun. The turret member 14 is received in bore 30 of the housing body 12 and extends across the longitudinal chamber 46. The turret member carries a spray tip orifice member 56 in a transverse bore 52. The housing body 12 is assembled to a housing adapter 58 to form a housing subassembly, which is shown in exploded view by FIG. 5. The adapter 58 has a through bore 63 and a threaded end 57 and an annular shoulder 61. Adapter 58 has an end flange 60 that is received within the retainer nut 34, and a low frictional characteristic, bearing washer 62 is captured between the annular rim 64 (see FIG. 4) of retainer nut 34 and flange 60 of adapter 58 and provides very low frictional resistance between the retainer nut 34 and the assembly of body 12 and adapter 58, when the retainer nut 34 is tightened. The housing subassembly is permanently secured by threading adapter 58 into internally threaded bore 50 in body 12. For this purpose, wrench flats 65 are formed on the internal end wall of bore 63 of adapter 58. The bore 50 also has a square shoulder, i.e., is unchamfered, to provide an abutment stop which precisely controls the axial positioning of adapter 58 in body 12. The central through passage 63 of adapter 58 provides the inlet port to the housing body 12, and this passage 63 receives the seal subassembly, which is also illustrated in FIG. 4, and in an exploded view by FIG. 6.

The seal subassembly (see FIG. 6) comprises a piston 76 with a through bore 77 which aligns with a central through bore 87 in seal 88. The seal 88 has a square face 89, to fit the square cross-sectional chamber 46 of body 12. The rear face of seal 88 has a boss 90 and a reduced diameter neck 92 which is received in a counterbore 74 of piston 76. This construction secures the subassembly during use of the spray tip, since the fluid pressure in the central passageway formed by the aligned bores 77 and 87, through the seal subassembly, will compress the neck 92 of the plastic seal tightly against the counterbore 74 of piston 76. Piston 76 has an annular groove 75 which receives a sealing washer, e.g., an O-ring 80 (see FIG. 4) to seal the piston in the central passage 63 of adapter 58. The upstream end of piston 76 has a reduced diameter neck 78 and a compression spring 66 is received over this neck.

The assembly of the spray tip on a spray gun and tightening of the retainer cap nut 34 on the threaded barrel 21 (see FIG. 1) of the spray gun applies an axial compression to the seal assembly. The compression spring 66 bears against the end of the spray gun barrel and applies a resilient force to the piston 76, insuring that a constant loading is applied to the seal 88, regardless of the tension applied to the retainer nut 34. A seal washer 69 is retained between the end of the spray gun barrel and the inside face of flange 60 of adapter 58.

Referring now to FIG. 4, the turret member 14 has a transverse bore 52 which is counterbored at 54 to receive spray tip orifice member 56. The orifice member 56 is firmly seated against the annular shoulder between bore 54 and counterbore 56. Bore 52 should be of sufficient length that the orifice tip 56 does not project beyond the cylindrical surface of turret member 14. The orifice member 56 is retained in the assembly by sleeve 55 which is pressed into the counterbore 54 and a sealing washer 57 is compressed against the orifice member 56 to seal this member in the counterbore 56.

Figure 7:
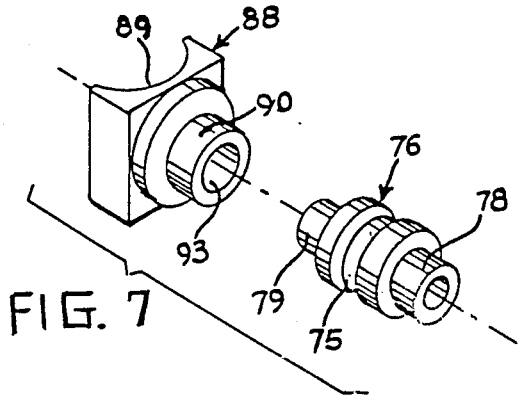
FIG. 7 is an exploded perspective view of an alternative seal subassembly.

Referring now to FIG. 7, an alternative construction for the seal subassembly is shown. The seal 88 is substantially the same as previously described with a square face 89 to fit in the chamber 46 of housing body 12. The rear face of seal 88 has a boss 90 which has an enlarged counterbore 93. The piston 76 has a reduced diameter neck 79 on its downstream end and this neck fits into the counterbore 93 of the seal 88. The remainder of the seal subassembly is the same as previously described with reference to FIG. 6, with annular groove 75 which receives an O-ring 80 to seal the piston in the central passage 57 of adapter 58 and a reduced diameter neck 78 on its upstream end to receive compression spring 66, previously described.

The seal is formed entirely of plastic, which is filled with from 5 to 50, preferably from 15 to about 30, weight percent of a reinforcement filler. Various plastics can be used for this purpose, including acetal homopolymer and copolymer, polysulfones, polyphenylene sulfide, polycarbonate, thermosetting and thermoplastic polyimides, Nylon, poly(amide-imide), etc. Acetal copolymer is preferred for its hardness and wear resistance. The acetal copolymer is prepared by the copolymerization of trioxane with slight amounts of a comonomer which provides carbon to carbon bonding in the polymer chain, thereby imparting a high degree of thermal stability to the polymer. The polymer has a very high creep resistance and a tensile strength in excess of 15,000 psi.

The fillers which can be used for reinforcement of the plastic seal body include graphite, silica, alumina powders, and fibrous reinforcements such as graphite and glass fibers. Preferably, glass fibers having lengths from about 0.05 to about 0.25 inch are used.

The spray tip of this invention is provided with a plurality of interchangeable turret members with varied sizes of orifice tips to permit the user to switch turret member whenever it is desired to change the volume or spread of the fan spray. The orifice tips can be provided in sizes from about 0.005 to about 0.075 inch in any varied increments, preferably in increments from about 0.001 to 0.003 inch. These orifice tips will provide a fan spray with a width from 2 to about 22 inches in approximately 2 inch increments.

Because the seal and seal support are indexed in the tip housing 12 against rotation, the cylindrically concave face 89 of the seal remains in axial alignment with the cylindrical bore 30 when the turret member is removed or replaced. Also, since the seal support 76 is restrained by its frictional fit with the piston 76, it can not fall out of position when the turret member is removed. Instead, it resists dislodgement and remains in place to insure that the turret member, or a replacement turret member, can be quickly inserted without need to reposition the seal support.

The invention provides a number of definite advantages over prior spray tips. The plastic seal of the invention tightly seals and minimizes leakage even with low viscosity liquids. The rigid seal support firmly supports the seal, and the compression spring insures that the seal does not seize the turret member and prevent its rotation by hand, even when the spray tip has been mounted on the spray gun for a prolonged period. The turret member can be quickly reversed to its clean-out position, any obstructions can be sprayed out of the orifice, and the turret member can be returned to its spraying position, all without loosening the retainer nut. The turret member is easily removable from the spray tip simply by loosening retainer cap nut 30 and rotating the turret member to align its prong with the notch of the spray guard. When the turret member is removed, the seal and seal support remain in place to permit rapid replacement of the turret member. The retainer cap nut can be tightened and loosened by hand and the spray tip can be rotated on the spray gun without loosening the cap nut.

The invention has been described with reference to the illustrated and presently preferred embodiment. It is not intended that the inention be unduly limited by this disclosure of the presently preferred embodiment. Instead, it is intended that the invention be defined by the means, and their obvious equivalents, set forth in the following claims.

I claim:

1. A spray tip comprising:

(a) a body subassembly comprising a housing having a longitudinal chamber, an intersecting orthogonal cylindrical bore, an open end and adapter means attached to its end opposite said open end for attachment of said body assembly to a spray gun including a central inlet passage to said housing;

(b) a cylindrical turret member rotatably seated in said intersecting orthogonal cylindrical bore and having a transverse bore rotatable into alignment with said inlet passage, said turret member including means for axially releasably and rotatably retaining said turret member within said orthogonal cylindrical bore;

(c) a spray tip orifice member mounted in said orthogonal cylindrical bore; and (d) a single seal subassembly axially slidably received in said longitudinal chamber and comprising:

(i) a turret member seal formed of a hard, reinforced plastic and having a rear face facing said inlet passage, a cylindrical concave seal surface facing said turret member and a through passageway therebetween;

(ii) a seal piston received in said central inlet passage of said adapter means and extending into abutting engagement with the rear face of said turret member seal and having a central through passageway aligned with the central through passageway of said turret member seal;

(iii) annular seal means received about said seal piston and engaging the inside walls of said through passage to effect fluid sealing of said piston against said line pressure within said passage.

2. The spray tip of claim 1 wherein said plastic is filled with from 5 to 45 weight percent reinforcement material.

3. The spray tip of claim 1 wherein said reinforcement material is fiber glass and is present in an amount from 10 to about 30 weight percent.

4. The spray tip of claim 1 wherein said plastic is an acetal copolymer.

5. The spray tip of claim 1 including resilient means positioned to bias said piston against said turret member seal.

6. The spray tip of claim 5 wherein said resilient means is a compression spring positioned to bias said piston against said seal and said piston has a reduced diameter shank received within said spring, to serve as a spring retainer.

7. The spray tip of claim 1 wherein said seal and seal piston form a seal subassembly with cooperative interlocking means therebetween.

8. The spray tip of claim 7 wherein said interlocking means comprises a reduced diameter sealing boss on the downstream face of said piston and a central counterbore in the upstream face of said seal to receive said sealing boss in a pressed fit.

9. The spray tip of claim 7 wherein said interlocking means comprises a central counterbore on said piston and a reduced diameter sealing boss on said seal to receive said sealing boss in a pressed fit.

10. The spray tip of claim 1 wherein said annular seal means includes an annular groove about said piston and an O-ring seated in said groove, to seal said piston in the central passage of said adapter means.

11. The spray tip of claim 1 wherein said adapter means is a flanged connector sleeve which is threadably received in said spray tip housing and including a retainer cap nut received over said sleeve with a low friction, bearing washer captured between the annular flanges of said cap nut and said flanged connector sleeve.

12. The spray tip of claim 1 including index means to restrain said turret member seal against rotation within said longitudinal chamber when the fluid pressure is released and when said turret member is removed and replaced.

13. The spray tip of claim 12 wherein said housing has a non-circular cross section and said turret member seal has a mating shape, thereby serving as said index means.

14. The spray tip of claim 13 wherein said housing has a rectangular cross-section.

15. A combination of a spray gun having a discharge barrel with an externally threaded discharge end and a spray tip received thereon and comprising:

(a) a spray tip subassembly including an outer, annular flange and an inlet passage on one end and a housing open at its end opposite said one end and having a longitudinal chamber and an intersecting orthogonal cylindrical bore;

(b) a cylindrical turret member rotatably seated in said intersecting orthogonal cylindrical bore and having a transverse bore rotatable into alignment with said inlet passage, said turret member including means for axially releasably and rotatably retaining said turret member within said orthogonal bore;

(c) a spray tip orifice member mounted in said transverse bore; and (d) a single seal subassembly axially slidably received in said longitudinal chamber and comprising:

(i) a turret member seal formed of a hard, reinforced plastic received in said longitudinal chamber and having a rear face facing said inlet passage and a cylindrical concave seal surface facing said turret member with a central through passageway therebetween;

(ii) a seal piston received in said central inlet passage and extending into abutting engagement with said turret member seal and having a central through passageway aligned with the central through passageway of said turret member seal; and (iii) a compression spring captured between said piston and said spray gun discharge barrel; and (e) a retainer nut received over said outer flange of said housing and threadably engaged onto said externally threaded end of said spray gun discharge barrel, compressing said spring between said end of said discharge barrel and said seal piston.

16. The combination of claim 15 wherein said plastic is filled with from 5 to 45 weight percent reinforcement material.

17. The combination of claim 16 wherein said reinforcement material is fiber glass and is present in an amount from 10 to about 30 weight percent.

18. The combination of claim 17 wherein said plastic is an acetal copolymer.

19. The combination of claim 15 including a flanged adapter sleeve with one end threadably received in the rear wall of said spray tip housing and bearing said annular flange on its end opposite said one end.

20. The combination of claim 19 including a low friction bearing washer captured between the annular flange of said adapter sleeve and said retainer nut.

21. The combination of claim 15 wherein said piston has a reduced diameter upstream end received within said compression spring.

22. The combination of claim 15 wherein said seal and seal piston form said seal subassembly with cooperative interlocking means therebetween.

23. The combination of claim 22 wherein said interlocking means comprises a central counterbore on said piston and a reduced diameter sealing boss on said seal to receive said sealing boss in a pressed fit.

24. The combination of claim 22 wherein said interlocking means comprises a reduced diameter sealing boss on said piston and a central counterbore in said seal to receive said sealing boss in a pressed fit.

* * * * *